United States Patent [19]

Katz

[11] Patent Number: 4,640,529

[45] Date of Patent: Feb. 3, 1987

[54] FLEXIBLE NON-DISTORTABLE HANDCRAFT SHEET MATERIAL AND METHOD OF APPLYING PRINTED DESIGNS THERETO

[76] Inventor: Marcella M. Katz, 10573 Le Conte Ave., Los Angeles, Calif. 90024

[21] Appl. No.: 776,759

[22] Filed: Sep. 16, 1985

[51] Int. Cl.[4] ..... B42D 19/00

[52] U.S. Cl. ..... 281/5; 428/131; 428/906.6; 112/439

[58] Field of Search ..... 281/5, 2, 1; 283/1 R, 283/62, 61; 282/11.5 A; 112/439; 428/131, 906.6, 195

[56] References Cited

U.S. PATENT DOCUMENTS 3,669,814 6/1972 Faltin ..... 281/5 X
4,070,223 1/1978 Stalzer ..... 281/2 X

*Primary Examiner*—Nancy A. B. Swisher
*Attorney, Agent, or Firm*—Philip D. Junkins

[57] ABSTRACT

Flexible non-distortable handcraft sheet materials, including needlework fabrics, adaptable for receiving printed designs, patterns, photographs and craft instructional information and the methodology for producing the materials with the designs, patterns and photographs and instructional information printed thereon. Material alignment and feed features are located along the parallel edges of the materials for moving same through a computer-directed printer. In accordance with the methodology visual information in the form of designs, patterns, photographs, flat art work, still objects, live objects, etc. is converted into digital information through a digitizer with the digitized image information thereafter fed to a computer for manipulation and editing by software and keyboard direction and for conversion to visual image information for CRT display and for utilization by a computer printer as imprinted graphic information. The flexible handcraft sheet materials bearing printer feed features include: paper and paper laminates; leather, suede, simulated leather, paper-leather and plastic-leather laminates; paper-thin woods, wood veneers and wood alminates with paper or plastic; laminates including non-woven, spun-bonded random fiber plastic sheet; plastic and paper-plastic laminates; foils and foil laminates; and like craft materials.

23 Claims, 11 Drawing Figures

FLEXIBLE NON-DISTORTABLE HANDCRAFT SHEET MATERIAL AND METHOD OF APPLYING PRINTED DESIGNS THERETO

BACKGROUND OF THE INVENTION

1. Field of the Invention

The present invention relates to handcraft sheet materials. More particularly, the invention relates to needlwork materials having a uniform pattern of apertures forming a symmetrical gridwork intended to receive needle-directed yarn or thread for the purpose of creating a stitchery design thereon and to other flexible handcraft sheet materials including paper, plastics, leather, wood and fabrics. The present invention further relates to materials of the type described which are adaptable for receiving printed designs, patterns, photographs and instructional information and to methods of printing designs, patterns, photographs and instructional information thereon.

2. Description of the Prior Art.

a. Needlework. Embroidery is the art or process of forming decorative designs with hand needlework. When an open-mesh canvas or apertured sheet material having a uniform gridwork is used to receive the needlework, the art form is characterized as "needlepoint" or "canvas embroidery." Needlepoint is distinguished from other forms of embroidery, such as crewel embroidery, in that in needlepoint the stitches are formed by passing needle-directed yarn or thread through openings in the canvas or apertured sheet material in simple even stitches across counted threads or between counted apertures.

Needlepoint canvas, in its simplest form, is comprised of evenly spaced, durable wrap and woof threads woven into a textile in which the holes or apertures between the threads are commonly equal to or larger in size than the threads themselves. The canvas threads are usually composed of cotton or linen fibers, particuarly where the gauge of the canvas (number of threads per inch) falls within the popular range of 10 to 18. Fine gauge needlepoint fabrics normally have 18 to 40 threads per inch and are woven from silk or synthetic fiber threads in addition to cotton and linen fiber threads. Textile and fabric materials, manufactured for use as needlepoint canvas, are usually sold by their manufacturers in "bolt" (roll) units having a minimum of 5–10 yards of material.

The principal types of needlepoint canvases in use today are designated "mono-" meaning one thread on each side of each hole or aperture and "double" meaning two threads on each side of each major hole or aperture. There are two basic forms of mono- canvases, i.e., "mono-floating" and mono-interlock." With mono-floating canvas the warp and weft (woof) threads are merely woven over and under each other whereas with mono-interlock canvas the warp threads (in fact) comprise two smaller (weaker) threads that are knotted or twisted at each over and under crossing of weft threads. Because of the weaving method, mono-floating canvases are subject to greater slippage between threads so that the mesh pattern of the canvas easily becomes distorted, i.e., the holes or apertures become of non-uniform size and configuration with repeated folding and needlepoint working of the canvas.

Double thread needlepoint canvas (also referred to as "Due" or "Penelope") is woven with the warp and woof threads that form the principal holes or apertures of the canvas each comprised of a pair of slightly spaced threads which form small apertures. This weave of needlepoint canvas is useful when it is desired to use half stitches or where petit point stitches (small) and gross point stitches (large) are to be worked on the same canvas. Other fine woven textiles used in the needlework arts include cloths woven so that the individual threads are thicker than the holes between them, "even weave" cloth and "Congress" cloth.

From time to time other forms of needlepoint canvas have been manufactured. For example, molded plastic, large gauge (4–15) mesh sheets, with a surface texture simulating the warp and woof thread configuration of woven needlepoint canvas, or with a smooth surface texture, have been made. Also, perforated paper sheets have been made and proposed for needlepoint projects of relatively small size where the resulting needlework is to be framed as a decorative item or where a free-form craft item is to by created using needlework techniques, i.e., book markers, greeting cards, etc.

Mono-floating and mono-interlock needlepoint canvases have continued to be used for most stitchery applications despite their many shortcomings and the problems they create for the needlepoint artisan. The principal shortcomings and problems include edge raveling, canvas distortion, aperture irregularity and roughness, and thread shifting. Great care must be taken when cutting bolt or yardage canvas into smaller popular use size canvas pieces to make crtain that each cutting course or line follows a single line of canvas holes or apertures, i.e., between warp and woof threads, so that edge raveling is minimized. Edge raveling becomes an even greater problem when the ultimate shape of the needlepoint piece is not rectangular with its edges not in parallel with warp and woof threads.

Canvas distortion, stretching, sagging, extension and creep constitute major problems to persons performing needlepoint stitchery. If one closely observes needlework canvas as needlepoint stitchery is applied, it becomes obvious that the vertical and horizontal forces applied to the canvas threads (defining each aperture in the canvas) by the yarn-guiding needle and the yarn itself (as they pass through such apertures) are unequal. Although canvas manufacturers have attempted to reduce the distortion problem through the weaving of mono-interlock canvases and by the application of sizing (stiffening) agents to the canvas threads, the problem remains. Distortion correction, after completion of the needlework piece, by straightening or "blocking" the base canvas (and the needlework it bears) must overcome many built-in failure factors. Blocking, a somewhat costly procedure, involves the stretching and straightening of the needlework to its pre-stretched size and shape.

The foregoing problems with needlepoint canvas materials have been obviated through the improved needlepoint materials described in my co-pending U.S. patent applications: Ser. No. 714,128, filed Mar. 20, 1985; Ser. No. 737,702, filed May 28, 1985; and Ser. No. 738,450, filed May 28, 1985. The needlepoint canvas materials disclosed in these applications are basically flexible, non-distortable composite laminated sheet materials comprised of a primary layer of non-elastic, open-mesh woven needlepoint fabric which has bonded to one of its faces a relative thin, non-elastic secondary mesh-stabilizing layer of sheer (semi-transparent) fabric. The primary layer is preferably a non-floating or noninterlock needlepoint canvas material. The sheer fabric secondary layer of the composite laminated needlepoint canvas material is preferably a non-woven, semi-transparent, random-spun synthetic fiber material or a sheer closely woven fabric material. The secondary layer is of such a sheerness that the holes or apertures of the canvas primary layer remain distinct to the needlepoint artisan and the secondary layer is relatively thin so that it is easily penetrated by the yarn-bearing stichery needle.

An infinite number of decorative fabrics may be formed by applying needlework techniques to needlework canvas materials. These fabrics may vary widely in stitch type, yarn tickness, yarn colors, etc. Although some needlework artisans create their own stitchery designs while sewing a fabric or create a design on pape and reproduce it on the fabric, a primary source of designs is provided in kit form with the kit containing a pattern, the yarn types and colors and an appropriate canvas material, or needlwork patterns are sold independently.

There are five principal variables associated with each needlework design, i.e., (a) stitch types, (b) stitch placement, (c) canvas grid or mesh size, (d) yarn thickness and (e) yarn color. Yarn thickness and canvas mesh size can be readily indicated by simple directions on the pattern while stitch types, stitch placement and yarn color directions are more difficult to indicate.

Where fine embroidery on linen or other fine mesh material is to be performed by the artisan, the design or pattern may be printed, drawn or painted on (or transferred to) the fabric and the artisan merely sews over the design or pattern. With needlepoint designs, stitch type variation is usually involved. Further, since the commonly used canvas types (10 to 18 mesh) are substantially air space (apertures greater than canvas thread thickness), printing of stitch type instructions is not feasible since most stitchery is directionally oriented. Also, the present-day woven canvas materials are distortable and not perfectly true in mesh or grid structure and when design printing thereon is attempted, the design frequently does not properly align with the gridwork of the canvas with the result that stitch type location is faulty. Only thread-by-thread hand painted designs are true and they are very time consuming and costly to produce.

In view of the foregoing state-of-the-art in needlework stitchery, popularly priced designs are most commonly shown on separate charts indicating the specific location of stitch types and yarn colors on a line gridwork representing the canvas gridwork. In using these charts, the needlework artisan must refer to the chart beore applying one or several more stitches. Constant backand-forth cross-reference between the chart and the needlework piece is necessary.

b. Leatherwork. Leatherwork encompasses the cutting, tooling and burning of decorative designs in leathers, tanned leathers, suede materials and a wide selection of imitation and simulated leather materials. Also, leatherwork may include handcraft design work that involves such materials in design punched or cut forms with the addition of a variety of attached media and adornments. As in the case of needlework, it is desirble to apply designs and patterns to leather and leather-like materials for their instructional utility in the performance of cutting, punching, tooling, burning, and adornment handcraft procedures and for their non-functional decorative effects.

c. Paperwork. Numerous handcraft ideas have been suggested and developed involving the use of paper, construction paper, flexible paper board and like materials. Again, designs and patterns are frequently applied to these materials in their flat, pre-crafted state as instructional information and as decorative design matter to add to the overall visual effect of the finished handcraft item.

d. Woodcraft. Thin, flexible sheets of wood, wood veneers and wood-simulated plastics have come into popular use in the handcraft arts. As with leatherwork materials, wood and wood-like materials used in handcraft projects usually require the application of decorative design and pattern instructional information for use in the performance of cutting, punching, burning and mixed-media application procedures and for adding to the visual appearance of the final craft item.

e. Plasticwork and Foils. The wide variety of flexible sheet plastic materials and foil materils in a full range of colors and tints have made such materials highly desirable for handcraft projects. Metalized plastic mosaics in flexible sheet form are, for example, being used as a craft medium for making fashion accessories including belts, necklaces, rings and pendants. The need for the imprinting of designs and handcraft patterns on these types of materials is increasing.

It is an object of the present invention to provide improved handcraft sheet materials having a print surface adaptable for receiving computer-generated printed designs, patterns, photographs and instructional information thereon.

It is a further object of the invention to provide an improved needlework material having a print surface on one face thereof adaptable for receiving printed needlework designs, patterns and photographs in stitchery alignment with the gridwork of such needlework material as directed by a computer.

It is a still further object of the invention to provide leather, simulated leather, paper, flexible woods and wood veneers, flexible plastic, foils, metalized plastic and like materials to be utilized as handcraft sheet materials having a print surface on one or both faces thereof adaptable for receiving printed designs, patterns, photographs and instructional information as directed by a computer.

It is another object of the invention to provide a unique method for producing handcraft sheet materials which have printed thereon detailed designs, patterns, photographs and instructional information as directed by a computer.

It is still another object of the invention to provide a unique method for producing needlework material which has printed thereon detailed embroidery, needlepoint or mixed media cross-stitch designs, patterns or photographs in geometric stitchery alignment with the symmetrical gridwork of such needlework material.

It is yet another object of the invention to provide a unique method for printing designs, patterns or photographs on a wide variety of flexible sheet craft materials having a print surface on a face thereof with such designs, patterns or photographs being applied as directed by a computer.

Other objects and advantages of the invention will be apparent from the following detailed description of the invention, taken with the accompanying drawings.

SUMMARY OF THE INVENTION

The present invention relates to improved handcraft materials adaptable for receiving computer-directed printed designs, patterns, photographs and instructional information and the methodology for producing such material with such designs, patterns, photographs and instructional information printed thereon. In a principal species of the invention, the material comprises a flexible, non-distortable needlework material having: a uniform pattern of apertures or perforations forming a symmetrical gridwork for receiving needlework stitchery; a print surface on one or both sides adaptable for receiving computer-directed printed needlework designs, patterns, photographs and instructional information; and alignment and feed means located along the parallel edges of the material for moving it through a computer-directed printer for imprinting needlework designs, patterns and photographs on the print surface thereof in needlework stitchery alignment with the symmetrical gridwork of the material.

The flexible, non-distortable needlework material may be: any of the composite laminated canvas materials described in my previously mentioned co-pending U.S. patent applications; heavy paper having uniformly spaced perforations forming a gridwork of apertures and presenting a relatively smooth surface for receiving imprinted matter; or woven plastic fiber fabrics on extruded plastic, simulated woven open-mesh material presenting a surface adaptable for receiving imprinting. In some instances it may be desirable to provide the perforated paper materials and the extruded plastic open-mesh materials with a lamination of sheer fabric material (as in the case of materials of my co-pending applications) so that such materials have a full print surface. For each of the flexible, non-distortable needlework materials of the invention, the alignment and feed means located along the edges of the materials may most commonly comprise a line of uniformly spaced pin holes which penetrate the materials and correspond in size and edge spacing to the standardized pin-feed drive (tractor) mechanisms of the many well-known computer-directed printers. Some printers will frictionally engage the various materials without tractor drives or side bands may be applied to the materials to assure uniform frictional feeding thereof through the printer.

The methodology of the present invention for producing needlework materials bearing needlework designs, patterns and photographs in stitchery alignment with the symetrical gridwork of the materials and for producing other design-bearing craft materials, comprises the utilization of digitized images of designs, patterns, photographs, still objects, live objects, etc. (the subject matter for needlework stitchery) which are computer-directed to a printer. The printer is fed with the flexible, non-distortable needlework material of the invention with its print receiving surface. In accordance with the methology the visual information (the subject matter for needlework stitchery) is converted into digital information through a digitizer by breaking down the image (the subject matter) into an organized mesh of fine dots which each have an assigned specific numerical value representing the gray level of each dot. The digitizer may be of: the video type utilizing the standard video signal information from a video camera, a video cassette recorder or a video disk player; the optical type digitizer utilizing a light emitter and detector; or any other type of image capturing and transmitting system.

Digitized image information is fed to any one of the many available types and models of personal computers for conversion to visual image information for CRT display (black and white or color) and for utilization, as computer-directed, by a dot-matrix printer (black and white or color) or by a laser printer to print out the visual image information on the flexible, non-distortable needlework matrial of the invention.

Through a number of avialable computer software programs the digitized image information may be manipulated and edited by the computer through software menus and keyboard direction. Thus, a pattern selection line grid can be created that corresponds in mesh size to the gridwork of the needlework material upon which the printing of a design, pattern or photograph is to occur. The line grid may be displayed on the CRT unit with the visual image displayed in superimposed fashion thereon. The image may be shifted over the line grid for stitchery alignment purposes and the image may be block pixelized to render it as a mosaic pattern matched to the line grid (corresponding to the needlework grid). In addition, through appropriate software programs, artistic and color changes can be made with respect to the displayed image and unique effects can be created. After manipulating the displayed image as described above, the image information is computer-directed to the printer for imprinting (with or without the computer-created line grid) on the needlework material fed through the printer with the result that the dot-matrix image or laser image produced by the printer (and the computer-created line grid, if desired) is in symmetrical alignment with the gridwork of the needlework material.

In further species of the invention the improved handcraft materials adaptable for receiving computer-directed printed designs, patterns, photographs and instructional information comprise sheets of flexible, non-distortable: paper and paper laminates; leather, simulated leather, paper-leather and plastic-leather laminates; paper-thin woods and wood veneers and wood laminates with paper or plastic; laminates including non-woven, spun-bonded random fiber plastic sheets; plastic and paper-plastic laminates; foils and foil laminates; and like materials. As in the case of the needlework materials of the invention, these handcraft materials have a print surface on one or both sides adaptable for receiving computer-directed designs, patterns, photographs and instructional information and they have alignment and feed means located along the parallel edges thereof for moving same through a computer-directed printer for imprinting craft desings, patterns, photographs and instructional information on the print surface or surfaces thereof. The print surface or surfaces of any of the foregoing handcraft materials can be pretreated with thermal, dielectric and other electrosensitive coatings, photographic base coatings, water-fast coatings or other chemical coatings for improving image receptivity, color, detail or density.

PREFERRED EMBODIMENTS OF THE INVENTION

Figure 1A:
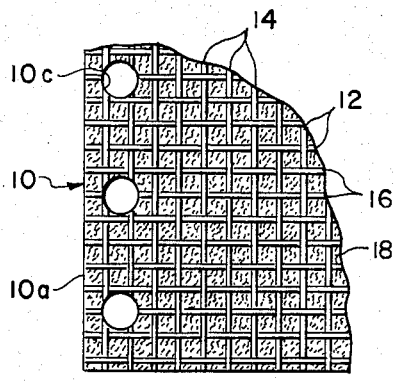
FIG. 1*a* is an enlarged segment of the piece of needlework material of FIG. 1.
Figure 1:
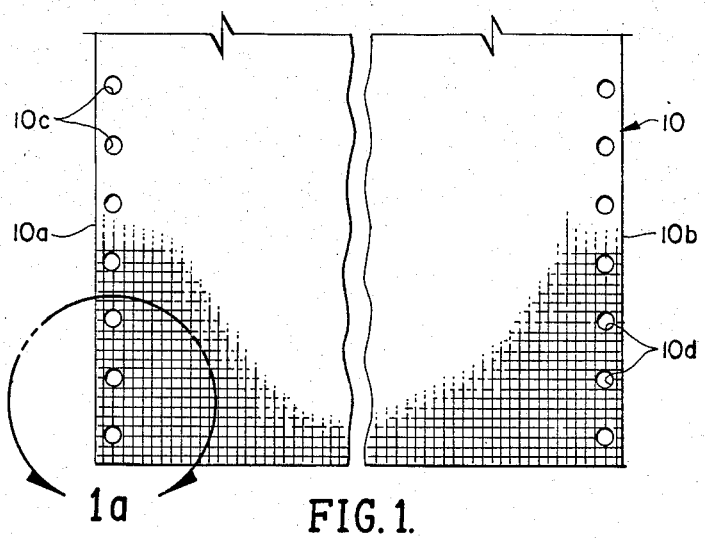
FIG. 1 is a plan view of a portion of a piece of woven, apertured needlework material embodying the features of this invention.
Figure 2A:
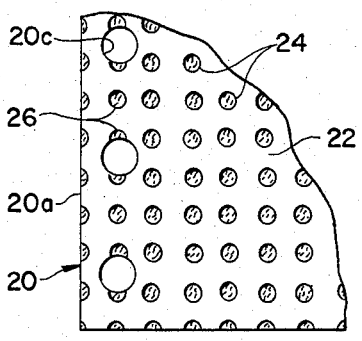
FIG. 2*a* is an enlarged segment of the piece of needlework material of FIG. 2.
Figure 2:
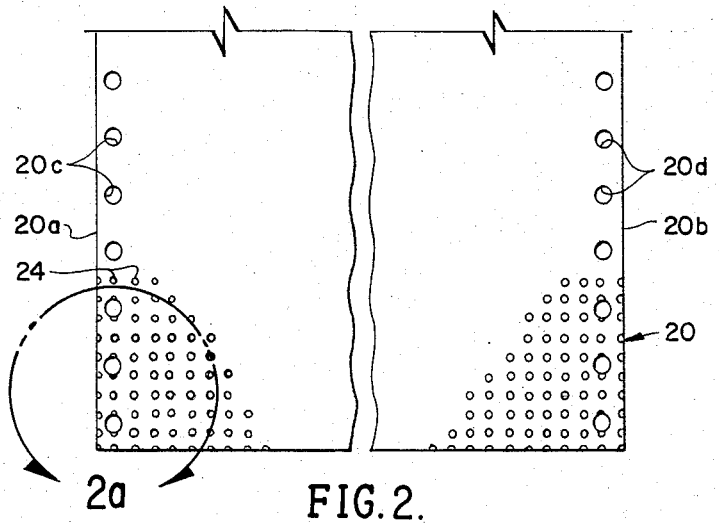
FIG. 2 is a plan view of a portion of a piece of non-woven, perforated paper needlework material embodying the features of this invention.
Figure 3A:
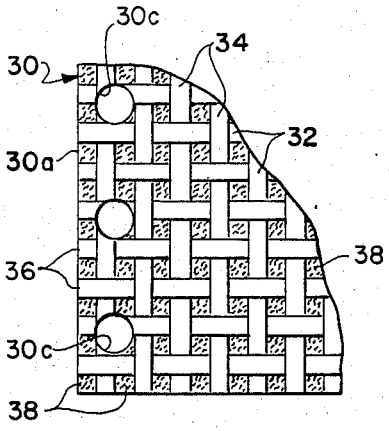
FIG. 3*a* is an enlarged segment of the piece of needlework material of FIG. 3.
Figure 3:
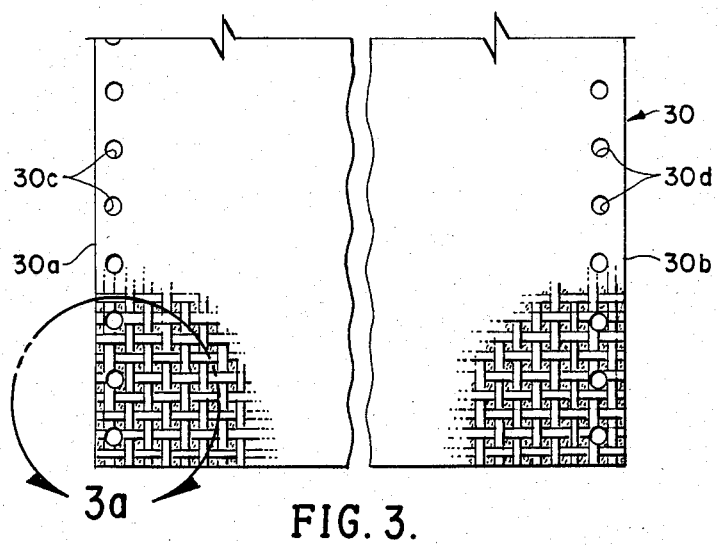
FIG. 3 is a plan view of a portion of a piece of extruded plastic, simulated woven apertured needlework material embodying the features of this invention.

Referring initially to FIGS. 1, 2 and 3 and to their respective segmental enlargements FIGS. 1*a*, 2*a* and 3*a* of the drawings, there is shown examples of the apertured and perforated needlework materials of the invention which are adaptable for receiving computer-generated printed needlework designs, patterns and photographs. In FIGS. 1 and 1*a* the apertured needlework material is a composite laminated needlepoint canvas material 10 comprised (as particularly shown in FIG. 1*a*) of a non-elastic, open-mesh woven needlework fabric primary layer 12 including warp threads 14 and weft threads 16, which has bonded directly to one of its faces a relatively thin, non-elastic, mesh-stabilizing secondary layer of sheer fabric material 18. The composite laminated needlepoint canvas material 10 may be any of the materials described in my co-pending U.S. patent applications: Ser. No. 714,128 filed Mar. 20, 1985; Ser. No. 737,702 filed May 28, 1985; and Ser. No. 738,450 filed May 28, 1985. These materials all present on their sheer fabric side a relatively smooth surface adaptable for receiving imprinted designs, patterns or photographs. Along each parallel edge 10*a* and 10*b* of material 10 are located a line of uniformly spaced pin holes 10*c* and 10*d*, respectively, which penetrate material 10 and correspond in size and edge spacing to the standardized pin-feed (tractor) drive mechanisms of many well-known computer-directed printers. Such printers commonly handle paper widths of 4 to 15.5 inches and special printers are available which accept paper widths of as much as 4 feet. Thus, in accordance with the present invention needlework materials of varying widths, and presenting a printable surface, may be fabricated with edge pin holes for moving such materials in positive drive through a computer-directed printer or the materials may be provided with side bands for frictionally moving same through a printer.

In FIGS. 2 and 2*a* the needlework material is a composite laminated material 20 comprised (as particularly shown in FIG. 2*a*) of a non-elastic, heavy, perforated paper primary layer 22 including uniformly spaced perforations 24 forming a grid of perforations for receiving needlework stitchery, which has bonded directly to one of its faces a relatively thin, non-elastic secondary layer of sheer fabric material 26. The sheer fabric side of the laminated material 20 presents a relatively smooth surface adaptable for receiving imprinted designs, patterns and photographs. Along each parallel edge 20*a* and 20*b* of material 20 are located a line of uniformly spaced pin holes 20*c* and 20*d*, respectively, which penetrate the material 20 and receive the standardized pin-feed drive mechanisms of computer-directed printers. In instances where there is adequate paper surface around the uniformly spaced perforations of material layer 22 it may not be necessary to bond a sheer fabric secondary layer to layer 22 to obtain a material surface adaptable for receiving imprinted designs, patterns or photographs. Thus, such imprinting by a computer-directed printer may be applied directly to a surface of the perforated paper which accepts the imprinted matter or has been treated to accept such imprinted matter.

In FIGS. 3 and 3*a* the needlework material is a composite laminated material 30 comprised (as particularly shown in FIG. 3*a*) of a non-elastic, extruded plastic, woven open-mesh needlework primary layer 32 including simulated warp components 34 and simulated weft components 36. The primary layer 32 has bonded directly to one of its faces a relatively thin, non-elastic secondary layer of sheer fabric material 38. The sheer fabric side of the laminated material 30 presents a relatively smooth surface adaptable for receiving imprinted designs, patterns or photographs. Along each parallel edge 30*a* and 30*b* of the material 30 are located a line of uniformly spaced pin holes 30*c* and 30*d*, respectively, which penetrate the material 30 and receive the standardized pin-feed drive mechanisms of computer-driven printers. In instances where the extruded plastic open-mesh primary layer 32 does not simulate woven needlework material but merely comprises an extruded plastic gridwork having a uniform pattern of apertures and the plastic surface around the apertures is smooth (no warp and weft surface texture), it may not be necessary to bond a sheer fabric secondary layer to layer 32 to obtain a material surface adaptable for receiving imprinted designs, patterns, or photographs. Thus, such imprinting by a computer-directed printer may be applied directly to a surface of the extruded plastic which accepts the imprinted matter or has been treated to accept such imprinted matter.

As previously indicated, apertured and perforated needlework materials of the invention may be provided in a variety of common printer widths ranging between 4 to 15.5 inches and in special situations in substantially greater widths. Preferably the material is supplied in bolts of several yards or more and fed from a spool into the computer-directed printer because of the thickness of the material and its stiffness as compared to common printer paper. Where the needlework material of the invention is reasonably flexible and relatively thin it may be fed to the printer as fanfolded material. Individual packets of separate pre-cut sheets of the needlework materials may also be fed to the printer. The edge strips of the needlework material including the pin holes may be cut away from the material after it has received the imprinted subject matter. Alternatively, the pin holes may be utilized as mounting means for the finished needlework item, or means for connecting the finished or unfinished needlework item to another correlant craft material or craft construct.

Figure 4A:
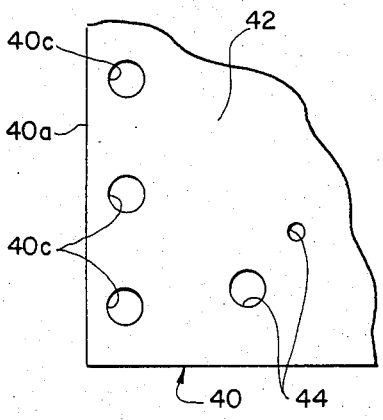
FIG. 4*a* is an enlarged segment of the piece of craft material of FIG. 4.
Figure 4:
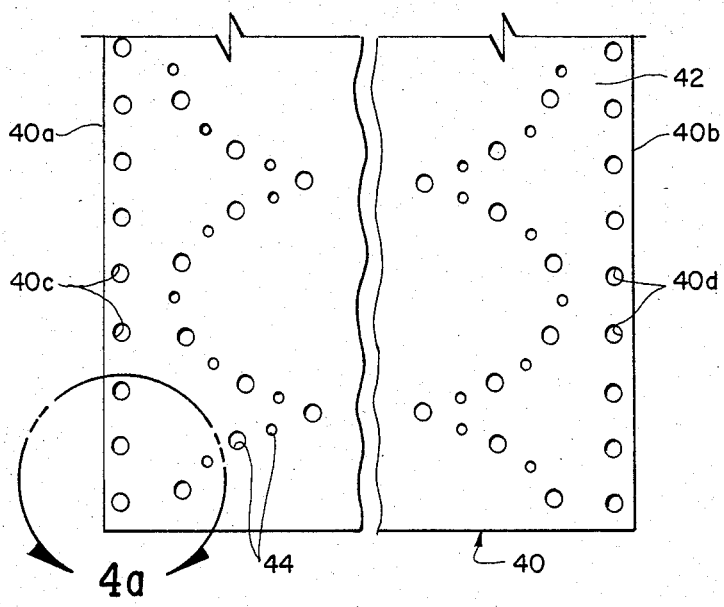
FIG. 4 is a plan view of a portion of a piece of leather, simulated leather, paper, plastic, foil or other sheet craft material having a random perforation design and embodying the features of this invention.

In FIGS. 4 and 4*a* the craft material is a sheet 40 of leather, tanned leather, suede or simulated leather, a laminate of leather and leather-like material with an adhesive coating on a carrier material such as relaease paper, or a sheet of craft paper or craft plastic or laminate of such material with an adhesive coating on a release carrier material or a foil material or foil laminate. The single layered or primary layer of material 42 of sheet 40, as shown, includes various sizes of punched holes or perforations 44 forming a design of perforations leaving large material surface areas for the imprinting of designs and crafting instructional information. Where the sheet material 40 comprises a laminate of materials the primary layer material 42 may be permanently or temporarily bonded to a secondary layer of material (not shown). Thus, the primary layer may be carried by a secondary release paper layer or non-woven fabric material bearing a release adhesive and the computer-directed imprinting may be applied to the secondary layer of paper or non-woven fabric material or to the primary layer 42. Along the parallel edge 40*a* and 40*b* of material 40 are located a line of uniformly spaced pin holes 40*c* and 40*d*, respectively, which penetrate the material 40 (layer 42 and any secondary laminate layer) and receive the standardized pin-feed drive mechanisms of computer-directed printers. The design or pattern imprinted on material 40 may be instructive as to crafting steps to be taken (cutting, tooling, punching, burning, coloring, affixing, etc.), may provide non-functional decorative art work on the material, or may be functionally related or inter-related to other craft materials or craft constructs forming a part of the material 40 or to be matched to or associated with such material.

Figure 5A:
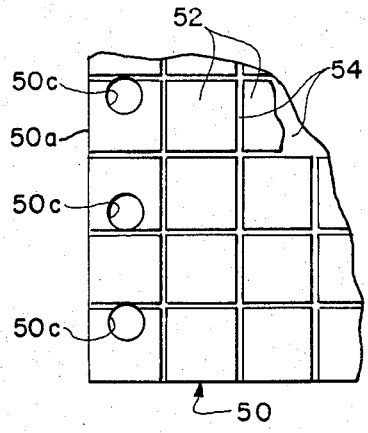
FIG. 5*a* is an enlarged segment of the piece of mosaic craft material of FIG. 5.
Figure 5:
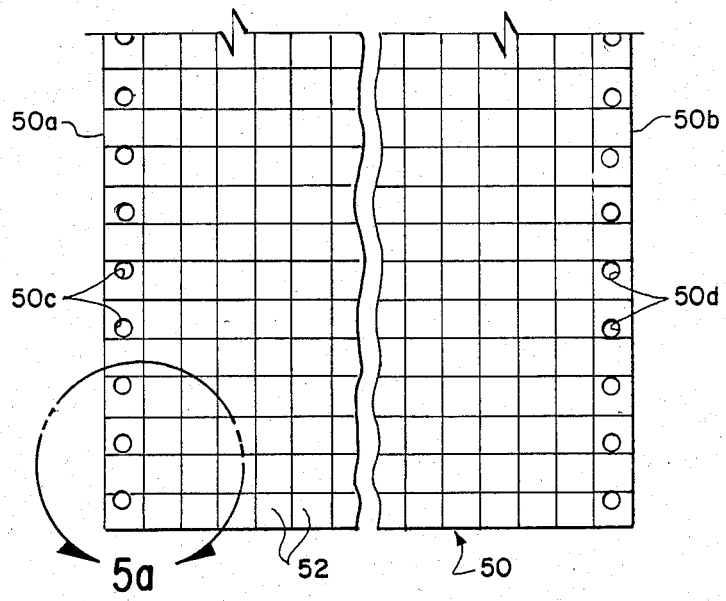
FIG. 5 is a plan view of a portion of a piece of flexible plastic mosaic sheet craft material embodying the features of this invention.

In FIGS. 5 and 5*a* the craft material is a flexible sheet 50 of plastic pieces 52 forming a mosaic arrangement mounted on a self-adhesive layer 54 (see FIG. 5*a*) protected by a backing layer (not shown). The plastic pieces can be scored and bent for crafting purposes and are adaptable to printing for the receipt of designs and patterns. Along the parallel edge 50*a* and 50*b* of material 50 are located a line of uniformly spaced pin holes 50*c* and 50*d*, respectively, which penetrate the material 50 (layer of plastic pieces 52, self adhesive layer 54 and backing layer) and receive the standardized pin-feed (tractor) drive mechanisms of computer-directed printers.

Figure 6:
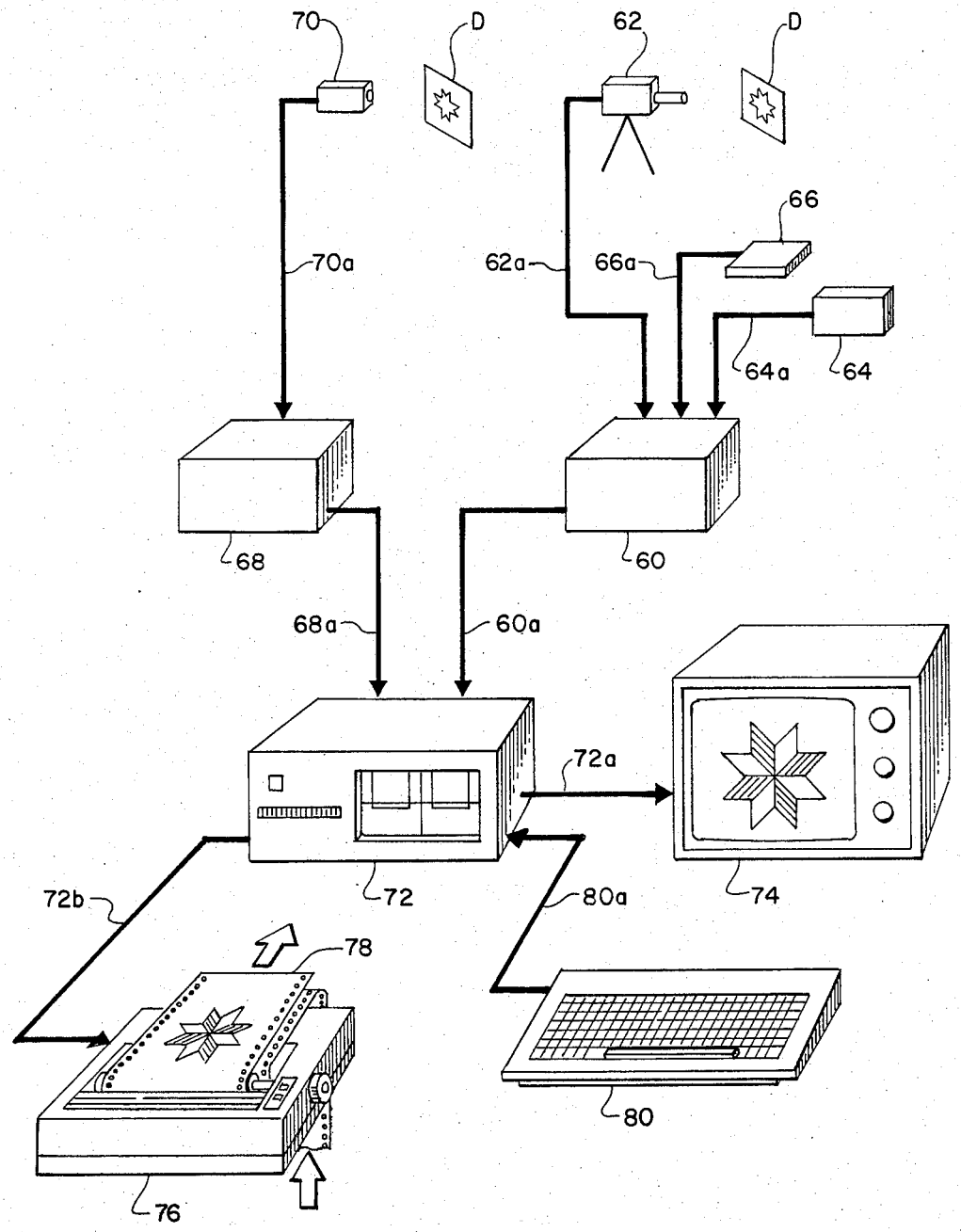
FIG. 6 is a somewhat diagrammatic showing of alternative methods of applying designs, patterns or photographic prints to a print surface of the handcraft materials of this invention.

Referring now to FIG. 6 there is shown in somewhat diagrammatic fashion the methodology of applying designs, patterns, photographs and craft instructional information to a print surface of one of the handcraft materials of this invention. For purposes of describing the methodology, the handcraft material illustrative thereof is a flexible, non-distortable needlework material comprised of a laminate of open-mesh woven needlepoint fabric which has bonded to one of its faces a relatively thin secondary mesh-stabilizing layer of non-woven, semi-transparent (sheer), random-spun, synthetic fiber material, the secondary layer providing this handcraft material with a print surface for receiving printed design, pattern, photographic and/or instructional information.

As previously mentioned, the methodology of the invention for producing needlework and other craft materials bearing designs, patterns, photographs and craft instructional information comprises the utilization of digitized images of designs, patterns, photographs, still objects, live objects, etc. (the subject matter for needlework stitchery) which are computer-directed to a printer. The printer is fed with the flexible, non-distortable sheet handcraft material (needlework material, etc.) of the invention with its print receiving surface. In accordance with the methodology the visual information (the design subject matter) is converted into digital information through a digitizer. As shown in FIG. 6 the digitizer may be of either the video type 60 utilizing the standard video signal information from a video camera 62, a video cassette recorder 64 or a video disk player 66 (fed to digitizer 60 by their respective transmission cables 62*a*, 64*a* and 66*a*) or the optical type 68 utilizing a light emitter and detector unit 70 with the optical signal information fed to digitizer 68 via transmission cable 70*a*. All digitizers convert visual information into digital information by breaking down an image into a mesh of fine dots and assigning a specific numerical value to the gray level found in each dot. Video digitizers use standard video signals created by scanning flat designs, photographs, and three-dimensional objects (still and alive). As shown in FIG. 6 video camera 62 is scanning a flat design D. Optical digitizers, through their emitter-detector system of present day design, scan only photographs, illustrations or other flat artwork D. The emitter projects a tiny beam of light onto the flat image and the light sensitive detector senses the degree of lightness or darkness in each dot of the image as the beam goes over it. Thus, optical digitizers base their generated digital information on the light beam's reflection value. A video digitizer turns the video signals it receives into a stream of binary numbers, reducing the light intensities represented by the video signal to a high-contrast image which a computer can represent digitally.

The digitized image information derived through a video digitizer 60 or by an optical digitizer 68 is fed through transmission cable 60*a* or 68*a*, respectively, to any one of the many available types and models of personal computers represented in FIG. 6 as micro-computer system unit 72. The micro-computer 72 converts the digitial image information into visual information and transmits same via cable 72*a* to a CRT display unit 74 (black and white or color picture) for viewing. The digital image information is also utilized by micro-computer 72 to direct a printer 76 of either the dot-matrix or laser type to print out (black and white or color) the visual image information on the flexible, non-distortable handcraft material 78 of the invention. The readily available and less expensive dot-matrix printers create visual images by producing a series of dots laid out on a grid pattern. These dots are produced by one of three printing methods, i.e., impact, thermal or ink-jet. Computer direction of printer 76 is accomplished via transmission cable 72*b* and the computer is responsive in its transmitting of display information to CRT display unit 74 and printout information to printer 76 to the commands generated by keyboard 80 (through cable 80*a*) and graphic and artistic software programs and menus supplied to the computer.

As previously indicated, through a number of available computer software programs the digitized image information relating to a given design, pattern or photograph may be manipulated by, and edited through, keyboard direction. A pattern line grid can be created that corresponds in mesh size to the line girdwork formed by the threads of needlework canvas materials upon which the computer-aligned and computer-directed printing of a design, pattern or photograph is to occur. The computer-created line grid may be displayed by the CRT unit with the visual image proposed for needlework handcrafting displayed in superimposed fashion thereon. The displayed image may be shifted over the displayed line grid for alignment purposes and the image (if video originated) may be block pixelized to render it as a mosaic pattern matched to the squares within the line grid (corresponding to the needlework apertures) or to cross points of the line grid (corresponding to the thread cross points of the needlework material). An image may be "zoomed" down and then "zoomed" back up to its original size. This process squeezes information out of the image and then displays the image in its lower resolution and thereby more obvious pixel shape, "posturization" can further enlarge the pixel groups and create abstracts of an image. With optical digitization the generated pixels are generally rectangular so that only blocks of pixels can be made to be exactly aligned with the square gridwork of needlework canvas materials. Thus, computer technology and aesthetics are merged and displayed. The computer image pixels, like the needlework apertures, are an array of small squares which build into a larger picture or geometric design. Placing these pixels exactly in line with or within the screen grid (and thus the needlework grid) allows the computer-directed printer to print a mosaic-like picture on the sheer print surface of the needlework material in alignment with the apertures of the woven primary layer of such material. This makes possible the merger of user-friendly printer interfacing off the computer screen canvas of mosaic computer imagery onto the printer-fed classic woven textile craft form of needlework canvas imagery. Herein, the modern computer signature translates with precision onto the ancient needlework artforms.

The foregoing tranposition of visual images into digital information and back, via computer technology, to printed imagery in exact alignment with the gridwork of the needlecraft materials of the invention equals and supplants the need for costly hand painted needlework materials. Furthermore, the methodology of the invention elminates the tedium of back-and-forth reference between needlework material and craft chart guidelines and stitchery information.

Through a number of software programs, artistic and color on-screen designing changes can be made with respect to the CRT displayed image and unique effects can be created and thereafter printed out on the needlework or other craft materials of the invention. Thus, image zooming, shifting, rotating, mirroring, stretching, shrinking, transposing, color cycling, color enhancing, mating, multiplying, etc. can be accomplished through software and keyboard direction. After finishing image manipulation as viewed on the CRT screen, the displayed image information (with or without a computer-created line grid matching the needlework grid) is computer-directed to the printer for imprinting on the needlework or other craft matreial as fed through the printer with the result that the visual printed image, produced by the printer, is in symmetrical alignment with the gridwork of the needlework material or in synchronized positioning on the print surface of these and other craft materials. In the case of needlework designs, computer-generated grid outlines can be rendered in any number of different pattern choices to match the particular material to be imprinted. For example, dot grid symbols can be established and embellished in precise dot alignment with the perforations of the needlework paper material of the invention bearing a non-woven laminate backing providing a full print surface. Further, grid symbols can be chosen and supplied in the printed image which exactly match the slant of stitch directions.

It will be apparent through the foregoing descriptions of the handcraft materials of this invention and of the methodology of the invention (described for the most part in connection with unique needlework materials) that a multitude of craft materials can now be made available which bear printed desings, patterns, photographs and instructional information. The printed matter is applied to the craft materials in exact alignment with the features of the materials (gridwork, slits, cutouts, paste-ons, perforations, etc.) so that the artisan can readily create a superior crafted item with the printed matter incorporated therein as the functional, directional information for accomplishing the crafting and/or to provide non-functional visual decorative effects in the crafted item. The means for feeding the handcraft materials of the invention through a computer-directed printer often may serve as a functional feature of the crafted item, i.e., mounting, binding, edging means and the like. Where required by the nature of the craft type, the material may include a carrier material such as release paper or non-woven fabric material leaving the ultimate print-bearing craft sheet adhesive free or leaving the craft sheet with pressure sensitive adhesive coating for mounting purposes.

In the specification and drawing figures there has been set forth preferred embodiments of the invention and although specific terms have been employed, they are used in a generic and descriptive sense only and not for purposes of limitation, the scope of the invention being defined in the following claims.

What is claimed is:

1. A flexible non-distortable handcraft sheet material having a print surface on at least one side thereof for receiving computer-generated print designs, patterns, and photographs as craft instructional or decorative visual information for use in creating finished handcrafted items incorporating the printed areas of said sheet material, said handcraft sheet material having alignment and feed means located along the edges thereof for moving said material through a computer-directed printer for imprinting a design, pattern or photograph on the print surface thereof.

2. The flexible non-distortable handcraft sheet material as claimed in claim 1 wherein the alignment and freed means located along the edges of said handcraft material comprises a line of uniformly spaced pin holes through said material for receiving the pin-feed drive mechanisms of a computer-directed printer.

3. The flexible non-distortable handcraft sheet material as claimed in claim 1 wherein the alignment and feed means located along the edges of said handcraft material comprises means for frictionally engaging the friction feed drive mechanism of a computer-directed printer.

4. The flexible non-distortable handcraft sheet material as claimed in claim 1 wherein said handcraft material is needlework material selected from the group comprising woven canvas with a relatively thin secondary layer of sheer non-elastic material bonded thereto, perforated paper, and extruded plastic gridwork material.

5. The flexible non-distortable handcraft sheet material as claimed in claim 1 wherein said handcraft material is selected from the group comprising: paper and paper laminates; leather, suede and simulated leather;

paper-leather and plastic-leather laminates; paper-thin woods, wood veneers and wood laminates with paper or plastic sheet material; plastic sheet materials; non-woven random-spun plastic fiber sheet material; plastic and paper-plastic laminates; metallic foils and foil-paper and foil-plastic laminates; paper and plastic sheet carrier materials bearing secondary handcraft sheet materials adhered to the carrier materials via release or pressure sensitive adhesives; and any of the foregoing handcraft materials pre-treated with coatings to improve image printing receptivity, color, detail or density.

6. A non-distortable needlework material having a uniform pattern of apertures forming a symmetrical gridwork for receiving needlework yarn and having a print surface adaptable for receiving computer-generated printed needlework designs, patterns and photographs, said needlework material having alignment and feed means located along the edges thereof for moving said material through a computer-directed printer for imprinting a design, pattern or photgraph on the print surface of said material in needlework stitchery alignment with the symmetrical gridwork of said material.

7. The non-distortable needlework material as claimed in claim 6 wherein the alignment and feed means located along the edges of said needlework material comprises a line of uniformly spaced pin holes through said material for receiving the pin-feed drive mechanisms of a computer-directed printer.

8. The non-distortable needlework material as claimed in claim 6 wherein said needlework material is a fabric selected from the group comprising mono-floating, mono-interlock and double thread woven canvas material, congress cloth, even-weave fabric and other woven needlework fabrics.

9. The non-distortable needlework material as claimed in claim 6 wherein said needlework material is a perforated paper material.

10. The non-distortable needlework material as claimed in claim 6 wherein said needlework material is an extruded plastic gridwork material.

11. A composite laminated, non-distortable needlework material adaptable to the imprinting thereon of a needlework design, pattern or photograph by a computer-directed printer comprising:

(a) a primary layer of non-elastic material having a uniform pattern of apertures forming a symmetrical gridwork for receiving needlework yarn;

(b) a relatively thin secondary layer of sheer non-elastic material bonded to said primary layer, said secondary layer presenting a print surface for receiving computer-generated printed needlework designs, patterns and photographs; and (c) material alignment and feed means located along two parallel edges of said laminated needlework material for moving said material through a computer-directed printer for imprinting a design, pattern or photograph on the print surface of the secondary layer of said material in needlework stitchery alignment with the symmetrical gridwork of said primary layer.

12. The composite laminated, non-distortable needlework material as claimed in claim 11 wherein the material alignment and feed means located along the two parallel edges of said laminated needlework material comprises a line at each of said edges of uniformly spaced pin holes through said needlework material for receiving the pin-feed drive mechanisms of a computer-directed printer.

13. The composite laminated, non-distortable needlework material as claimed in claim 11 wherein the primary layer of non-elastic material is a fabric selected from the group comprising mono-floating, mon-interlock and double thread woven canvas material, congress cloth, evenweave fabric and other woven needlework fabrics.

14. The composite lamianted, non-distortable needlework material as claimed in claim 11 wherein the primary layer of non-elastic material is a perforated paper material.

15. The composite laminated, non-distortable needlework material as claimed in claim 11 wherein the primary layer of non-elastic material is an extruded plastic gridwork material.

16. The composite laminated, non-distortable needlework material as claimed in claim 11 wherein the relative thin secondary layer of sheer non-elastic material bonded to said primary layer is a non-woven, random-spun synthetic fiber textile material.

17. The composite laminated, non-distortable needlework material as claimed in claim 11 wherein the relatively thin secondary layer of sheer-non-elastic material bonded to said primary layer is a closely woven textile material.

18. A method of producing handcraft sheet materials bearing imprinted designs, patterns or photographs as craft instructional or decorative visual information for use in creating finished handcraft items incorporating the printed area of said sheet materials comprising the steps of:

(a) digitizing an image consisting of the design, pattern or photographic subject matter to be applied to the handcraft sheet materials to convert the visual image information respecting said design, pattern or photographic subject matter into digital image information;

(b) feeding the digital image information to a computer;

(c) feeding a flexible non-distortable sheet of handcraft material to an electronic printer, said sheet material presenting a surface adaptable for receiving imprinting thereon; and (d) printing the selected handcraft design, pattern or photographic subject matter comprising the visual image information on the print surface of said sheet of handcraft material via the electronic printer as directed by said computer.

19. The method of producing handcraft sheet materials as claimed in claim 18 wherein said handcraft material is needlework material selected from the group comprising woven canvas with a relatively thin secondary layer of sheer non-elastic material bonded thereto, perforated paper, and extruded plastic gridwork material.

20. The method of producing handcraft sheet materials as claimed in claim 18 wherein said handcraft material is selected from the group comprising: paper and paper laminates; leather, suede and simulated leather; paper-leather and plastic-leather laminates; paper-thin woods, wood veneers and wood laminates with paper or plastic sheet material; plastic sheet materials; non-woven random-spun plastic fiber sheet material; plastic and paper-plastic laminates; metallic foils and foil-paper and foil-plastic laminates; paper and plastic sheet carrier materials bearing secondary handcraft sheet materials adhered to the carrier material via release or pressure sensitive adhesives; and any of the foregoing handcraft materials pre-treated with coatings to improve image printing receptivity, color, detail or density.

21. A method of producing a needlework canvas material bearing an imprinted design, pattern or photograph in stitch application alignment with the symmetrical thread-defining gridwork of said material comprising the steps of:

(a) digitizing an image consisting of the design, pattern or photographic subject matter to be applied to needlework canvas materials to convert the visual image information respecting said design, pattern or photographic subject matter into digital image information;

(b) feeding the digital image information to a computer;

(c) feeding a composite laminated, non-distortable needlework material to an electronic printer, said needlework material comprised of a primary layer of non-elastic, open-mesh woven fabric and a relatively thin secondary mesh-stabilizing layer of sheer non-elastic fabric material bonded to the threads of said primary layer and presenting a surface adaptable for receiving imprinting thereon; and (d) printing the selected needlework design, pattern or photographic subject matter comprising the visual image information on the secondary layer of said composite needlework canvas material via the electronic printer as directed by said computer.

22. A method of producing handcraft sheet material bearing imprinted designs, patterns or photographs as craft instructional or decorative visual infomration for use in creating finished handcraft items incorporating the printed areas of said sheet materials comprising the steps of:

(a) digitizing an image consisting of the design, pattern or photographic subject matter to be applied to the handcraft sheet materials to convert the visual image information respecting said design, pattern or photogrpahic subject matter into digital image information;

(b) feeding the digital image information to a computer and scanning said digital information to reproduce the digitized image on the screen of a display unit;

(c) feeding a flexible non-distortable sheet of handcraft material to an electronic printer, said sheet material presenting a surface adaptable for reeiving imprinting thereon; and (d) printing the selected handcraft symbols and color shades corresponding to the design, pattern or photographic subject matter comprising the visual image information on the print surface of said sheet of handcraft material via the electronic printer as directed by said computer.

23. A method of producing a needlework canvas material bearing an imprinted design, pattern or photograph in stitch application alignment with the symmetrical thread-defining gridwork of said material comprising the steps of:

(a) digitizing an image consisting of the design, pattern or photographic subject matter to be applied to needlework canvas materials to convert the visual image information respecting said design, pattern or photographic subject matter into digital image information;

(b) feeding the digital image information to a computer and scanning said digital image information to reproduce the digitized image on the screen of a display unit;

(c) applying a computer program symmetrical gridwork via said computer to the reproduced digitized image on the screen of said display unit, said computer program gridwork corresponding in size and configuration to the symmetrical thread-defining gridwork of a needlework canvas material;

(d) converting the reproduced digitized image via said computer to selected needlework stitch symbols and color shades corresponding to the design, pattern or photographic subject matter comprising the visual image information and aligning said stitch symbols and color shades via said computer with the computer program gridwork;

(e) feeding a composite laminated, non-distortable needlework material to an electronic printer, said needlework material comprised of a primary layer of non-elastic, open-mesh woven fabric and a relatively thin secondary mesh-stablizing layer of sheer non-elastic fabric material bonded to the threads of the primary layer and presenting a surface adaptable for receiving imprinting thereon; and (f) printing the selected needlework stitch symbols and color shades corresponding to the design, pattern or photographic subject matter comprising the visual image information on the secondary layer of said composite needlework canvas material via the electronic printer as directed by said computer in alignment with the symmetrical thread-defining gridwork of said needlework material.

* * * * *